US005310418A

United States Patent [19]

Czech

[11] Patent Number: 5,310,418

[45] Date of Patent: May 10, 1994

[54] METHOD OF IMPARTING DURABLE PRESS PROPERTIES TO COTTON TEXTILES WITHOUT USING FORMALDEHYDE

[75] Inventor: Anna M. Czech, Peekskill, N.Y.

[73] Assignee: Union Carbide Chemicals & Plastics Technology Corporation, Danbury, Conn.

[21] Appl. No.: 73,943

[22] Filed: Jun. 8, 1993

Related U.S. Application Data

[63] Continuation-in-part of Ser. No. 767,676, Sep. 30, 1991, abandoned.

[51] Int. Cl.[5] ..... D06M 13/12

[52] U.S. Cl. ..... 8/116.4; 8/116.1

[58] Field of Search ..... 8/116.4, 116.1, 115.6

[56] References Cited

U.S. PATENT DOCUMENTS

| | | | |
|---|---|---|---|
| 2,548,455 | 4/1951 | Walker et al. | 8/116.4 |
| 3,511,699 | 5/1970 | Johnson et al. | 117/135.5 |
| 4,184,004 | 1/1980 | Pines et al. | 428/413 |
| 4,269,602 | 5/1981 | Worth et al. | 8/116.4 |
| 4,269,603 | 5/1981 | Worth | 8/116.4 |
| 4,448,977 | 5/1984 | Warner et al. | 549/201 |
| 4,472,167 | 9/1984 | Welch | 8/116.4 |
| 4,619,668 | 10/1986 | Frick, Jr. et al. | 8/116.4 |
| 4,818,243 | 4/1989 | Chance et al. | 8/116.4 |
| 4,888,093 | 12/1989 | Dean et al. | 8/116.1 |
| 4,900,324 | 2/1990 | Chance et al. | 8/116.4 |

FOREIGN PATENT DOCUMENTS 0360248 3/1990 Fed. Rep. of Germany .

OTHER PUBLICATIONS

J. G. Frick, Jr. et al., *Acetals as Crosslinking Reagents for Cotton, Journal of Applied Polymer Science,* vol. 29, 1433–1447 (1984).

*Primary Examiner*—Jacqueline V. Howard

*Attorney, Agent, or Firm*—St. Onge Steward Johnston & Reens

[57] ABSTRACT

The invention provides a method for imparting durable press properties to a cotton-containing textile which avoids the use of formaldehyde and the problems associated therewith, which method comprises treating a textile with an aqueous finishing agent solution comprising at least one acetal of glutaraldehyde and at least one acidic catalyst and optionally contains a silicone softener and/or a pH-maintaining additive such as sodium perborate.

16 Claims, No Drawings

METHOD OF IMPARTING DURABLE PRESS PROPERTIES TO COTTON TEXTILES WITHOUT USING FORMALDEHYDE

This is a continuation-in-part of U.S. Ser. No. 07/767,676, filed Sep. 30, 1991, now abandoned.

BACKGROUND OF THE INVENTION

1. Field of the Invention

The present invention is directed to a method of imparting durable press properties to cotton textiles without using formaldehyde. More particularly, the invention is directed to a method of treating cotton textiles to impart durable press properties using acetals of glutaraldehyde.

2. Prior Art

Present-day textile finishing treatments that impart durable press properties use formaldehyde or form formaldehyde in situ as one of the ingredients to make durable press finishes. This formaldehyde can be released during the treatment of textiles or during storage and manufacture of garments made from the treated textile. Recently, there has been increasing concern over safety and health hazards associated with the use of formaldehyde. It has been determined that exposure to formaldehyde on textiles or in the air can cause allergic reactions in some persons. It has further been suggested that formaldehyde may be a carcinogen.

Efforts are being made to develop durable press treatments which eliminate formaldehyde or formaldehyde-based compounds in textile treatment. U.S. Pat. Nos. 4,269,603 and 4,472,167 disclose formaldehyde-free durable press finishes based on glyoxal chemistry with cellulose. Other dialdehydes, for example, glutaraldehyde, were found to be effective as cellulose crosslinking reagents (Japanese Publication No. 48061796 and European Patent Application No. 360,248,A2). However, the use of glutaraldehyde requires special handling precautions due to the presence of irritating vapors.

Dimethoxy-, diethoxy-, and diisopropoxy- pyrans have been reported by J. G. Frick, Jr., and R. J. Harper, Jr., "Acetals as Crosslinking Reagents for Cotton," *Journal of Applied Polymer Science*, Vol. 29, 1433–1447(1984). Since these symmetrical dialkoxypyrans are insoluble in water, they require an organic solvent for incorporating them into fabric treating compositions.

Surprisingly, it has been discovered that cotton textiles can be treated with an aqueous solution comprising an acetal of glutaraldehyde, without the disadvantage of using an organic solvent, to produce finished fabrics or textiles having durable press properties such as good dimensional stability, tensile retention, and crease resistance, as well as enhanced softness.

SUMMARY OF THE INVENTION

The invention is directed to a method for imparting durable press properties to a cotton-containing textile, which method avoids using formaldehyde and the problems associated therewith, which method comprises treating the textile with an aqueous finishing solution comprising at least one acetal of glutaraldehyde and at least one curing catalyst.

DETAILED DESCRIPTION OF THE INVENTION

The present invention is directed to a method of applying a durable press finish to a cotton-containing textile. Suitable cotton-containing textiles include, for example, cotton, flax, jute, hemp, ramie and regenerated unsubstituted wood celluloses such as rayon. The textile may be a blend of cellulose fibers and synthetic fibers such as, for example, a cotton/polyester blend. Preferably, the method of the present invention is used to impart durable press properties to cotton and cotton/-polyester blends. The cotton-containing textiles can be woven or knitted.

Acetals of Glutaraldehyde

Acetals of glutaraldehyde useful in the method of the present invention have the general formula:

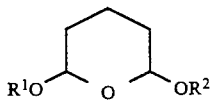

(I)

In Formula I, $R^1$ is selected from the group consisting of:

(i) an alkyl group having 1 to 12 carbon atoms, preferably 1 to 4 carbon atoms;

(ii) a hydroxyalkyl group having 1 to 12 carbon atoms, preferably 1 to 6 carbon atoms;

(iii) a polyoxyalkylene group containing polyoxyethylene units (EO), polyoxypropylene units (PO), or a mixture thereof and wherein the polyoxyalkylene group has a molecular weight of less than 2000, preferably less than 1000;

(vi) a polyoxyalkenyl-substituted aryl group wherein the polyoxyalkenyl-substituted substituent contains polyethylene units, polypropylene units or a mixture thereof and wherein the substituent has a molecular weight of less than 2000, preferably less than 1000.

In Formula I, $R^2$ is selected from the group consisting of (i) a hydroxyalkyl group having 1 to 12 carbon atoms, preferably 1 to 6 carbon atoms;

(ii) a polyoxyalkylene group containing polyoxyethylene units (EO), polyoxypropylene units (PO), or a mixture thereof and wherein the polyoxyalkylene group has a molecular weight of less than 2000, preferably less than 1000;

(iii) a polyoxyalkenyl-substituted aryl group wherein the polyoxyalkenyl-substituted substituent contains polyethylene units, polypropylene units or a mixture thereof and wherein the substituent has a molecular weight of less than 2000, preferably less than 1000.

Preferably $OR^1$ has 1 to 6 carbon atoms and is selected from the group consisting of methoxy, ethoxy, hydroxypropoxy, hydroxy-diethoxy, hydroxy-dipropoxy, hydroxy-triethoxy, hydroxy-butoxy and hydroxy-hexyloxy. Preferably, $OR^2$ has 1 to 12 carbon atoms and is selected from the group consisting of hydroxypropoxy, hydroxy-diethoxy, hydroxy-dipropoxy, hydroxy-triethoxy, hydroxy-butoxy and hydroxy-hexyloxy. The most preferred acetals of glutaraldehyde are those in which $OR^1$ is selected from the group consisting to methoxy, ethoxy, and hydroxy-triethoxy and $OR^2$ is hydroxy-triethoxy.

In the method of the present invention, the most preferred acetals of glutaraldehyde are selected from the group consisting of 2-hydroxytriethoxy-6-methoxy-tetrahydropyran, 2-hydroxytriethoxy-6-ethoxy-tetrahydropyran, and 2,6-bis(hydroxytriethoxy)tetrahydropyran, and mixtures thereof.

It is to be understood that the acetals of glutaraldehyde employed in the method of this invention may be used in substantially pure form or as a mixture containing isomers thereof, such as cis-and trans- isomers, as well as open chain derivatives and oligomers containing two or more pyran units, which isomers, derivatives, and oligomers typically form during acetal preparation. Acetals of glutaraldehyde which can be employed in the method of the present invention hydrolyze at ambient temperature and pressure in the presence of acid. Further, the acetals of glutaraldehyde are storage stable and may be stored for an extended period of time.

Acetals of glutaraldehyde useful in the method of the present invention can be easily prepared according to the procedure described in U.S. Pat. No. 4,448,977. In general, acetals of glutaraldehyde used in the present invention are prepared by reacting 3,4-dihydro-2-methoxy-2H-pyran or 3,4-dihydro-2-ethoxy-2H-pyran with a stoichiometric or excess amount of an alcohol or a diol in the presence of an acid catalyst. The reactants are stirred at room temperature or at an elevated temperature for about 4 to 12 hours. When an excess of the alcohol or diol is used, the reaction mixture is subsequently stripped under vacuum for about 1 to 6 hours, preferably 2 to 3 hours, while maintaining a temperature from about 25° C. to 80° C., preferably about 40° C. to 60° C. Acidic catalysts used in the preparation of acetals of glutaraldehyde include, for example, phosphoric acid, p-toluenesulfonic acid or cation exchange resin. In order to reduce organic volatiles formed during the textile treating, high boiling alcohols or diols are preferred. Suitable high boiling alcohols include, for example, octanol, decanol, undecanol and dodecanol. Further, in general, it is known that acetals of glutaraldehyde prepared from high boiling alcohols may not be soluble in water, or are only slightly soluble in water, and, hence, are less acceptable in textile treatment. Suitable diols include, for example, glycols such as propylene glycol, diethylene glycol, dipropylene glycol, triethylene glycol, butanediol and hexanediol.

The preferred acetals of glutaraldehyde used in the present invention are the acetals prepared from the reaction of 3,4-dihydro-2-alkoxy-2H-pyran wherein the alkoxy groups contain 1 to 6 carbon atoms, or mixtures thereof with high boiling alcohols and/or glycols. Of these, 3,4-dihydro-2-methoxy-2H-pyran and 3,4-dihydro-2-ethoxy-2H-pyran or mixtures thereof are preferred. In contrast to the acetals of glutaraldehyde reported by Frick and Harper, supra., the acetals of the present invention are readily soluble in water and no organic solvent is required to produce homogenous treating fabric treating compositions using the compositions of the present invention.

In the preparation of these acetals of glutaraldehyde, it is expected that a mixture of isomers can be formed including low levels of open chain derivatives, as well as oligomers. These acetals of glutaraldehyde are preferred, in part, because they can be readily prepared from 2-alkoxy-dihydropyrans which are intermediates in the commercial synthesis of glutaraldehyde, and, hence, are readily available. Additionally, when compared to linear acetals or open chain acetals such as tetralkoxy- or tetrahydroxyalkoxy-pentanes, the cyclic acetals of the present invention produce lower levels of alcohol-containing and glycol-containing by-products during hydrolysis and curing.

Curing Catalyst

Curing catalysts useful in the present invention are Bronsted or Lewis acids capable of catalyzing the reaction of the acetal or hydrolyzed acetal of glutaraldehyde with the cotton-containing textile. Suitable curing catalysts can include, for example, p-toluenesulfonic acid, aluminum sulfate, zinc chloride, zinc tetrafluoroborate, aluminum chloride, magnesium chloride, aluminum chlorohydroxide, boric acid, oxalic acid, tartaric acid, citric acid, glycolic acid, lactic acid, malic acid and mixtures thereof. In a preferred embodiment, the catalyst is a mixture of magnesium chloride together with citric acid or a blend of oxalic acid and boric acid. When a blend of oxalic acid and boric acid is used, the ratio of oxalic acid to boric acid ranges from about 0.5:1 to about 2:1, preferably 0.75:1 to about 1.5:1 and most preferably is about 1:1. In general, the mole ratio of magnesium chloride to citric acid or the blend of oxalic acid and boric acid can range from 20:1 to 500:1, preferably from 50:1 to 200:1.

In the present invention the amount of catalyst ranges from about 0.01 to about 5% by weight, preferably about 0.5 to about 3.5% by weight, and most preferably about 0.8 to about 2.5% by weight, based upon the total aqueous finishing agent solution.

Silicone Softener

Optionally, silicone softeners can be employed in the method of the present invention. In general, silicone softeners are organomodified polysiloxanes. What is meant by "organomodified" polysiloxane is a polysiloxane in which some or all of the silicon atoms are substituted with organic groups other than a hydrocarbon group, such as aminoalkyl, hydroxyalkyl, ester, and the like. Suitable softeners include emulsified organomodified polysiloxanes such as hydrophobic organomodified polysiloxanes disclosed in U.S. Pat. Nos. 3,511,699; 4,504,549; and 4,076,695; or hydrophilic silicone copolymers such as those disclosed in U.S. Pat. Nos. 4,184,004; 4,684,709; and 4,645,691. Both types of silicone softeners enhance softness and crease resistance in cotton-containing textiles when employed in the method of the present invention. Examples of hydrophobic organomodified polysiloxanes include Magnasoft® Extra and TE-24 both available from Union Carbide Chemicals and Plastics Company Inc. Examples of hydrophilic silicone copolymers include Ucarsil® EPS and Ucarsil® HCP, likewise available from Union Carbide Chemicals and Plastics Company Inc. While silicone softeners having amino groups can be employed in the present invention, it is believed that such amino groups can cause yellowing of some textiles. Therefore, the softeners having amino groups are generally not preferred.

When silicone softeners are employed in the method of the present invention, the amount of the softener ranges from about 0.2 to about 5% by weight, preferably about 0.5 to about 4% by weight, and most preferably from about 1 to about 3% by weight based on the total aqueous finishing solution.

pH-Maintaining Additive

Optionally, in the present invention low levels of a pH-maintaining additive can be employed in the aqueous finishing solution to maintain the solution at a pH ranging from about 2.5 to 3.5. It is desired that the pH-maintaining additive form a pH buffer system with the curing catalyst. When employed, the amount of pH-maintaining additive used in the present invention can vary from about 0.01 to about 2% by weight, preferably from about 0.01 to about 1% by weight, and most preferably from about 0.02 to about 0.5% by weight, based on the total aqueous finishing solution. Preferably, the pH-maintaining additive is a sodium salt, potassium salt, or a mixture thereof. Illustrative sodium salts include, for example, sodium tetraborate (borax), sodium bicarbonate, sodium carbonate, sodium percarbonate and sodium perborate. Illustrative potassium salts include, for example, potassium tetraborate, potassium bicarbonate, potassium carbonate, potassium percarbonate and potassium perborate. The most preferred additive is sodium perborate since it is believed that sodium perborate acts not only as a pH-maintaining additive but also serves as a mild oxidant and/or enhances reflectance after aging as disclosed in U.S. Pat. No. 4,623,356. These additives are available from Aldrich Chemical Company, Inc. in Milwaukee, Wis.

Textile Treatment

In general, a cotton-containing textile is impregnated in a bath with the aqueous finishing solution and wet pick-up adjusted to 100% of the weight of the dry textile. Alternatively, the aqueous finishing solution may be applied by spraying or by other suitable application techniques known in the art. The moisture content of the impregnated textile may be initially reduced by heating at an elevated temperature for about 2 to about 30 minutes, preferably about 3 to about 15 minutes and most preferably about 3 to about 5 minutes prior to substantial curing. The drying temperature may vary depending on the textile composition but will generally range from about 50° C. to 110° C. The textile is then heated to cure the finish on the textile at a curing temperature of about 110° C. to 180° C., preferably ranging from about 115° C. to 170° C., most preferably from about 115° C. to 165° C. Drying and curing of the treated textile can be accomplished in one step by heating the textile at a temperature of about 110° C. to about 180° C. The time to dry and cure the finish is dependent on the amount of water remaining from the finishing solution to be evaporated and the temperature at which the textile is cured. Suitably the curing time is about 0.5 to 5 minutes. Alternatively, heating may be initiated, for example, at about 50° C. and gradually increased to about 180° C. over a sufficient period of time to dry and cure the finish on the textile.

Whereas the scope of the present invention is set forth in the appended claims, the following specific examples illustrate certain aspects of the present invention and, more particularly, point out methods of evaluating the same. It is to be understood, therefore, that the examples are set forth for illustration only and are not to be construed as limitations on the present invention. All parts and percentages are by weight unless otherwise specified.

Materials and Methods

The fabric used in the following examples was a bleached, desized mercerized cotton print cloth, Style 400M by Testfabric, Inc., Middlesex, N.J. The softness of the treated fabric was evaluated by a hand panel and the tested fabrics were rated using a scale of 1 to 10, where 1 is the softest and 10 is the harshest. In the examples, durable press properties are intended to refer to the overall properties of the textile including shrinkage control, wrinkle recovery angle, and smooth drying performance. In the examples, the test methods employed were the standard methods as understood by those skilled in the art and include: Wrinkle Recovery Angle (AATCC Method 66-1984), Durable Press Appearance (AATCC Method 124-1967), and Breaking Load and Elongation of Textile Fabrics (ASTM Method-D-1682-46).

EXAMPLE 1

Preparation of Acetals of Glutaraldehyde

Reagents as specified in Table 1, and cation exchange resin AG® 50W-X8 from BIO-RAD (4 g) were combined in a 250 ml round bottom flask and stirred at room temperature for 8 hours. In the preparation of Acetal V the reaction mixture was subsequently stripped under vacuum using an aspirator, while the temperature was maintained at 40° to 50° C. for 2 to 3 hours. The catalyst was removed by filtration. Acetals I and V were characterized by NMR.

TABLE 1

ACETALS OF GLUTARALDEHYDE COMPOSITIONS

| | ACETAL | | | | |
|---|---|---|---|---|---|
| | I | II | III | IV | V |
| 3,4-Dihydro-2-methoxy-2H-pyran | 57 g | 57 g | | | 45.6 g |
| 3,4-Dihydro-2-ethoxy-2H-pyran | | | 64 g | 64 g | |
| Triethylene glycol | 75 g | 37.5 g | 75 g | 37.5 g | 120 g |

EXAMPLE 2

Acetals of Glutaraldehyde as Durable Press Reagents

The aqueous finishing solutions were prepared as specified in Table 2 and applied to all-cotton fabrics in the pad bath. Fabrics were rolled to 100% wet pick up based on the original weight of the sample. Fabrics were dried at 107° C. for 2 minutes and cured at 150° C. for 1.5 minutes. The properties of the treated fabrics are also listed in Table 2.

Acetals I through IV were effective in reducing the shrinkage in fabric. Additionally, Acetals I and III, which employed magnesium chloride and a blend of oxalic acid and boric acid as the catalyst, produced stronger fabrics than Acetals II and IV as indicated by the percentage of retained tensile strength.

TABLE 2

TEXTILE TREATMENTS

| | Treatment #[1] | | | | | | Control |
|---|---|---|---|---|---|---|---|
| | 1 | 2 | 3 | 4 | 5 | 6 | 7 |
| Acetal I | 1.6 | 1.6 | | | | | |
| Acetal II | | | 1.1 | 1.1 | | | |
| Acetal III | | | | | 1.8 | | |
| Acetal IV | | | | | | 1.2 | |
| UCARSIL® EPS | 2.0 | 2.0 | 2.0 | 2.0 | 2.0 | 2.0 | |
| Magnesium Chloride | 1.5 | 1.5 | 1.5 | 1.5 | 1.5 | 1.5 | |
| Boric Acid/Oxalic Acid, 10%, 1:1 | 0.1 | | 0.1 | | 0.1 | 0.1 | |
| Tartaric Acid | | 0.1 | | 0.1 | | | |
| Water | 94.8 | 94.8 | 95.3 | 95.3 | 94.6 | 95.2 | 100 |
| Fabric Properties | | | | | | | |
| Initial Reflectance | 77.9 | 68.5 | 76.2 | 65.5 | 74.8 | 73.1 | 78.5 |
| Tensile Retained (%) | 60 | 16 | 52 | 24 | 57 | 36 | 100 |

TABLE 2-continued

| TEXTILE TREATMENTS | Treatment #[1] 1 | 2 | 3 | 4 | 5 | 6 | Control 7 |
|---|---|---|---|---|---|---|---|
| Wrinkle Recovery Angle (F + W) | 219 | 223 | 218 | 211 | 208 | 213 | 186 |
| Shrinkage (F/W), 1 Wash | 1.0/ 0.8 | 0.5/ 0.5 | 0.5/ 0.8 | 0.8/ 0.5 | 0.8/ 1.0 | 0.8/ 0.5 | 2.6/ 2.2 |
| Tensile Retained After Aging (%)[2] | 50 | 14 | 34 | 17 | 44 | 28 | 85 |
| Reflectance After Aging | 44.0 | 31.4 | 50.2 | 34.9 | 50.0 | 46.0 | 53.6 |

[1]all components of the compositions are parts by weight
[2]aging conditions 90° C./100% rel. humidity/24 hours

EXAMPLE 3

The Effect of Sodium Perborate on Fabric Properties

The aqueous finishing solutions were prepared as specified in Table 3 and applied to all-cotton fabrics in the pad bath. Fabrics were rolled to 100% wet pick up based on the original weight of the fabric. Fabrics were dried at 107° C. for 2 minutes and cured at 150° C. for 1.5 minutes. The properties of the treated fabrics are listed in Table 3.

TABLE 3

| TEXTILE TREATMENTS | Treatment # 8 | 9 | 10 |
|---|---|---|---|
| Acetal I | 1.6 | 1.6 | 2.5 |
| UCARSIL ® EPS | 2.0 | 2.0 | 2.0 |
| Magnesium Chloride | 1.5 | 1.5 | 1.5 |
| Sodium Perborate | | 0.1 | 0.2 |
| Oxalic Acid/Boric Acid, 10%, 1:1 | 0.1[3] | 0.3 | 0.8 |
| Water | 94.8 | 94.5 | 93.0 |
| Fabric Properties | | | |
| Initial Reflectance | 77.9 | 73.8 | 74.8 |
| Wrinkle Recovery Angle (W + F) | 219 | 240 | 269 |
| Shrinkage, 1 Wash, (F/W) | 1.0/ 0.8 | 0.3/ 0.6 | 0.9/ 0.7 |
| Reflectance After Aging | 43.9 | 52.5 | 38.2 |

[3]pH of the pad bath maintained at 3

Incorporation of low levels of sodium perborate to buffer the finishing solution and increasing the amount of the acetal in the finishing solution substantially improved wrinkle recovery angle values.

EXAMPLE 4

The Effect of Curing Conditions on Fabric Properties

The aqueous finishing solutions were prepared as specified in Table 4 and applied to all-cotton fabrics in the pad bath. Fabrics were rolled to 100% wet pick up based on the original weight of the fabric. Fabrics were dried at 107° C. for 2 minutes and cured at two different temperatures. The properties of the treated fabrics are also included in Table 4.

TABLE 4

| TEXTILE TREATMENTS | Treatment # 11 | 12 |
|---|---|---|
| Acetal I | 1.6 | 1.6 |
| Magnasoft ® Extra, 40% | 2.5 | 2.5 |
| UCARSIL ® EPS | 1.0 | 1.0 |

TABLE 4-continued

| TEXTILE TREATMENTS | Treatment # 11 | 12 |
|---|---|---|
| Magnesium Chloride | 1.5 | 1.5 |
| Oxalic Acid/Boric Acid, 10%, 1:1 | 0.3 | 0.3 |
| Sodium Perborate | 0.1 | 0.1 |
| Water | 93.0 | 93.0 |
| Curing Conditions | 150° C./ 90 sec | 171° C./ 90 sec |
| Fabric Properties | | |
| Initial Reflectance | 75.3 | 62.9 |
| Shrinkage, 1 Wash, (F/W), % | 0.5/ 0.6 | 0.2/ 0.5 |
| Wrinkle Recovery Angle (W + F) | 261 | 269 |
| Reflectance After Aging | 36.7 | 22.4 |

As evidenced by initial reflectance and reflectance after aging values, it can be seen that curing at the higher temperature (Treatment #12) resulted in more discoloration of the fabric as compared to Treatment #11. Shrinkage and wrinkle recovery angle remained essentially unchanged at the different curing temperatures.

EXAMPLE 5

Pad Bath Stability

Freshly prepared and aged finishing solutions, as specified below in Table 5, were applied onto the fabrics. Fabrics were rolled to 100% wet pick up based on the original weight of the fabric. Fabrics were dried at 107° C. for 2 minutes and cured at 150° C. for 1.5 minutes. Selected fabric properties were evaluated.

TABLE 5

| TEXTILE TREATMENTS | Treatment # 13 | 14 | 15 | 16 |
|---|---|---|---|---|
| Acetal I | 1.6 | 1.6 | 1.6 | 1.6 |
| UCARSIL ® EPS | 2.0 | 2.0 | 2.0 | 2.0 |
| Magnesium Chloride | 1.5 | 1.5 | 1.5 | 1.5 |
| Oxalic Acid/Boric Acid, 10%, 1:1 | 0.1 | 0.1 | 0.1 | 0.1 |
| Water | 94.8 | 94.8 | 94.8 | 94.8 |
| Time Delay, Hours | 0 | 1.5 | 3 | 6 |
| Fabric Properties | | | | |
| Initial Reflectance | 75.6 | 74.4 | 73.0 | 72.0 |
| Shrinkage, 1 Wash, (F/W) | 0.4/ 0.7 | 0.3/ 0.6 | 0.8/ 0.9 | 0.7/ 0.7 |
| Reflectance After Aging | 35.9 | 39.2 | 37.9 | 34.8 |

Freshly prepared or aged (up to 6 hours) finishing solutions were evaluated. No significant differences in fabric properties were observed using fresh or aged solutions.

EXAMPLE 6

The Effect of Silicone Softeners on Durable Press Performance

The aqueous finishing solutions were prepared as specified in Table 6 and applied to all-cotton fabrics in the pad bath. Fabrics were rolled to 100% wet pick-up, dried at 107° C. for 2 minutes and cured at 150° C. for 1.5 minutes. The properties of the treated fabrics are listed in Table 6.

TABLE 6

| TEXTILE TREATMENTS | Treatment # | | | |
|---|---|---|---|---|
| | 17 | 18 | 19 | 20 |
| Acetal V | 2.5 | 2.5 | 2.5 | 2.5 |
| UCARSIL ® EPS | | 2.0 | | 1.0 |
| Magnasoft ® Extra. 40% | | | 2.5 | 1.25 |
| Magnesium Chloride | 1.5 | 1.5 | 1.5 | 1.5 |
| Sodium Perborate | 0.2 | 0.2 | 0.2 | 0.2 |
| Oxalic Acid/Boric Acid, 10%, 1:1 | 0.8 | 0.8 | 0.8 | 0.8 |
| Water | 95.0 | 95.0 | 95.0 | 95.0 |
| Fabric Properties | | | | |
| Reflectance Ini. | 74.6 | 69.7 | 73.4 | 71.6 |
| Shrinkage, 1 Wash, W/F | 0.5/ 0.7 | 0.8/ 0.6 | 0.8/ 0.5 | 0.7/ 0.7 |
| Wrinkle Recovery Angle, W + F | 235 | 260 | 280 | 270 |
| Durable Press Appearance | 3.0 | 3.0 | 3.0 | 3.1 |
| Softness | 4.5 | 2.0 | 2.5 | 1.8 |

A comparison of Treatment #17 in Table 6 with Treatment #7 of Table 2 demonstrates that Acetal V (Treatment #17) was effective for imparting durable press properties to fabric.

From a comparison of Treatment #17 with Treatment #s 18–20 of Table 6, it can be seen that fabrics treated with silicone softeners, both hydrophilic and hydrophobic, have improved wrinkle recovery angle and softness (or "hand"). Further, the addition of a softener to the aqueous finishing solution had no adverse effect on the initial reflectance or shrinkage.

What is claimed is:

1. A method for imparting durable press properties to a cotton-containing textile, which method avoids using formaldehyde and the problems associated therewith, which method comprises treating the textile with an aqueous finishing solution comprising at least one curing catalyst and an acetal of glutaraldehyde having the formula (I)

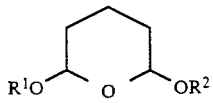

$R^1$ is selected from the group consisting of:

(i) an alkyl group having 1 to 12 carbon atoms, preferably 1 to 4 carbon atoms;

(ii) a hydroxyalkyl group having 1 to 12 carbon atoms, preferably 1 to 6 carbon atoms;

(iii) a polyoxyalkylene group containing polyoxyethylene units, polyoxypropylene units, or a mixture thereof and wherein the polyoxyalkylene group has a molecular weight of less than 2000, preferably less than 1000;

(iv) a polyoxyalkenyl-substituted aryl group wherein the polyoxyalkenyl-substituted substituent contains polyethylene units, polypropylene units or a mixture thereof and wherein the substituent has a molecular weight of less than 2000, preferably less than 1000; and $R^2$ is selected from the group consisting of (i) a hydroxyalkyl group having 1 to 12 carbon atoms, preferably 1 to 6 carbon atoms;

(ii) a polyoxyalkylene group containing polyoxyethylene units, polyoxypropylene units, or a mixture thereof and wherein the polyoxyalkylene group has a molecular weight of less than 2000, preferably less than 1000;

(iii) a polyoxyalkenyl-substituted aryl group wherein the polyoxyalkenyl-substituted substituent contains polyethylene units, polypropylene units or a mixture thereof and wherein the substituent has a molecular weight of less than 2000, preferably less than 1000.

2. The method according to claim 1 wherein $OR^1$ is selected from the group consisting of methoxy, ethoxy, hydroxypropoxy, hydroxy-diethoxy, hydroxy-dipropoxy, hydroxy-triethoxy, hydroxy-butoxy and hydroxy-hexyloxy; and wherein $OR^2$ is selected from the group consisting of hydroxypropoxy, hydroxy-diethoxy, hydroxy-dipropoxy, hydroxy-triethoxy, hydroxy-butoxy and hydroxy-hexyloxy.

3. The method according to claim 2 wherein $OR^1$ is selected from the group consisting of methoxy, ethoxy, and hydroxy-triethoxy and $OR^2$ is hydroxy-triethoxy.

4. The method according to claim 3 wherein the acetal of glutaraldehyde is selected from the group consisting of 2-hydroxytriethoxy-6-methoxy-tetrahydropyran, 2-hydroxytriethoxy-6-ethoxy-tetrahydropyran, and 2,6-bis(hydroxytriethoxy)tetrahydropyran and mixtures thereof.

5. The method according to claim 4 wherein the acetal of glutaraldehyde is 2,6-bis(hydroxytriethoxy)tetrahydropyran.

6. The method according to claim 1 wherein the finishing solution additionally contains a silicone softener.

7. The method according to claim 6 wherein the silicone softener is an organomodified polysiloxane selected from the group consisting of hydrophobic organomodified polysiloxanes and hydrophilic silicone copolymers.

8. The method according to claim 1 wherein the aqueous finishing solution additionally contains a pH-maintaining additive.

9. The method according to claim 8 wherein the pH-maintaining additive is selected from the group consisting of a sodium salt, a potassium salt, and a mixture thereof.

10. The method according to claim 9 wherein the pH-maintaining additive is sodium perborate.

11. The method according to claim 10 wherein the amount of sodium perborate ranges from about 0.01 to about 2% by weight based on the total amount of the aqueous finishing solution.

12. The method according to claim 1 wherein the curing catalyst is selected from the group consisting of p-toluenesulfonic acid, aluminum sulfate, zinc chloride, zinc tetrafluoroborate, aluminum chloride, magnesium chloride, aluminum chlorohydroxide, boric acid, oxalic acid, tartaric acid, citric acid, glycolic acid, lactic acid, malic acid, and mixtures thereof.

13. The method according to claim 12, wherein the curing catalyst is a mixture of magnesium chloride together with citric acid or a blend of oxalic acid and boric acid.

14. The method according to claim 13, wherein the mole ratio of magnesium chloride to citric acid or to the blend of oxalic acid and boric acid ranges from about 20:1 to 500:1.

15. The method according to claim 4 wherein the curing catalyst is a mixture of magnesium chloride together with citric acid or an equimolar blend of oxalic acid and boric acid; the silicone softener is a hydrophilic silicone copolymer; and wherein the aqueous finishing solution additionally contains sodium perborate.

16. The method of claim 15 wherein the acetal of glutaraldehyde is 2,6-bis(hydroxytriethoxy)tetrahydropyran.

* * * * *